US010431875B2

(12) United States Patent
Chang et al.

(10) Patent No.: US 10,431,875 B2
(45) Date of Patent: Oct. 1, 2019

(54) COMMUNICATION DEVICE

(71) Applicant: Wistron NeWeb Corp., Hsinchu (TW)

(72) Inventors: Wei-Shan Chang, Hsinchu (TW); Tsun-Che Huang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 15/399,030

(22) Filed: Jan. 5, 2017

(65) Prior Publication Data

US 2017/0352945 A1 Dec. 7, 2017

(30) Foreign Application Priority Data

Jun. 1, 2016 (TW) ..... 105208204 U

(51) Int. Cl.

| | |
|---|---|
| ***H01Q 1/24*** | (2006.01) |
| ***H01Q 1/48*** | (2006.01) |
| ***H01Q 9/04*** | (2006.01) |
| ***H01Q 9/06*** | (2006.01) |
| ***H01Q 1/36*** | (2006.01) |

(52) U.S. Cl.

CPC ..... *H01Q 1/243* (2013.01); *H01Q 1/36* (2013.01); *H01Q 1/48* (2013.01); *H01Q 9/0442* (2013.01); *H01Q 9/065* (2013.01)

(58) Field of Classification Search

CPC ..... H01Q 1/243; H01Q 1/36; H01Q 1/48; H01Q 9/0442; H01Q 9/065

See application file for complete search history.

(56) References Cited

U.S. PATENT DOCUMENTS

| | | | | |
|---|---|---|---|---|
| 4,812,855 | A * | 3/1989 | Coe | H01Q 9/065 343/700 MS |
| 6,320,544 | B1 * | 11/2001 | Korisch | H01Q 9/0407 343/700 MS |
| 7,046,196 | B1 * | 5/2006 | Langley | H01Q 1/243 343/700 MS |
| 2003/0160730 | A1 * | 8/2003 | Alsliety | H01Q 1/38 343/818 |
| 2004/0130492 | A1 * | 7/2004 | Egawa | H01Q 1/245 343/702 |
| 2004/0204006 | A1 * | 10/2004 | Zhou | H01Q 1/243 455/550.1 |
| 2005/0024267 | A1 * | 2/2005 | Jouvie | H01Q 1/38 343/700 MS |
| 2006/0017619 | A1 * | 1/2006 | Inatsugu | H01Q 9/0407 343/700 MS |
| 2006/0232492 | A1 * | 10/2006 | Sawatani | H01Q 1/2266 343/893 |
| 2007/0285334 | A1 * | 12/2007 | Tsutsumi | H01Q 1/2216 343/893 |

(Continued)

*Primary Examiner* — Daniel Munoz
*Assistant Examiner* — Bamidele A Jegede
(74) *Attorney, Agent, or Firm* — McClure, Qualey & Rodack, LLP

(57) ABSTRACT

A communication device includes a system ground plane, a signal source, an antenna structure, a radiation adjustment plane, and at least one tuning metal element. The signal source is coupled to the system ground plane. The antenna structure is coupled to the signal source. The radiation adjustment plane is configured to adjust the radiation of the antenna structure. The tuning metal element is disposed adjacent to the antenna structure, and is configured to modify the radiation pattern of the antenna structure.

17 Claims, 8 Drawing Sheets

(56) References Cited

U.S. PATENT DOCUMENTS

2008/0266190 A1* 10/2008 Ohba ..... H01Q 1/243
343/702
2010/0231464 A1* 9/2010 Huang ..... H01Q 1/38
343/702
2011/0012800 A1* 1/2011 Shamblin ..... H01Q 1/243
343/746
2011/0068990 A1* 3/2011 Grzyb ..... H01P 1/042
343/772
2012/0001815 A1* 1/2012 Wong ..... H01Q 1/243
343/749
2013/0069837 A1* 3/2013 Cozzolino ..... H01Q 13/10
343/727
2013/0120209 A1* 5/2013 Mak ..... H01Q 19/30
343/819
2013/0169503 A1* 7/2013 Fakharzadeh Jahromi .....
H01Q 1/243
343/833
2014/0049437 A1* 2/2014 Hung ..... H01Q 1/521
343/841
2014/0368396 A1* 12/2014 Shinkai ..... H01Q 1/38
343/817
2016/0306034 A1* 10/2016 Trotta ..... H01Q 9/0407
2016/0322702 A1* 11/2016 Sayama ..... H01Q 1/243

* cited by examiner

COMMUNICATION DEVICE

CROSS REFERENCE TO RELATED APPLICATIONS

This Application claims priority of Taiwan Patent Application No. 105208204 filed on Jun. 1, 2016, the entirety of which is incorporated by reference herein.

BACKGROUND OF THE INVENTION

Field of the Invention

The disclosure generally relates to a communication device, and more particularly, to a communication device and an antenna structure therein.

Description of the Related Art

With advancements in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements for mobile devices in the room to connect to the Internet at a high speed. However, since indoor environments have serious signal reflection and multipath fading, wireless access points should process signals from a variety of directions simultaneously. Accordingly, it has become a critical challenge for antenna designers to design an almost omnidirectional antenna structure in the limited space of wireless access points.

BRIEF SUMMARY OF THE INVENTION

In a preferred embodiment, the disclosure is directed to a communication device including a system ground plane, a signal source, an antenna structure, a radiation adjustment plane, and a first tuning metal element. The signal source is coupled to the system ground plane. The antenna structure is coupled to the signal source. The radiation adjustment plane is configured to adjust the radiation of the antenna structure. The first tuning metal element is disposed adjacent to the antenna structure, and is configured to modify the radiation pattern of the antenna structure.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
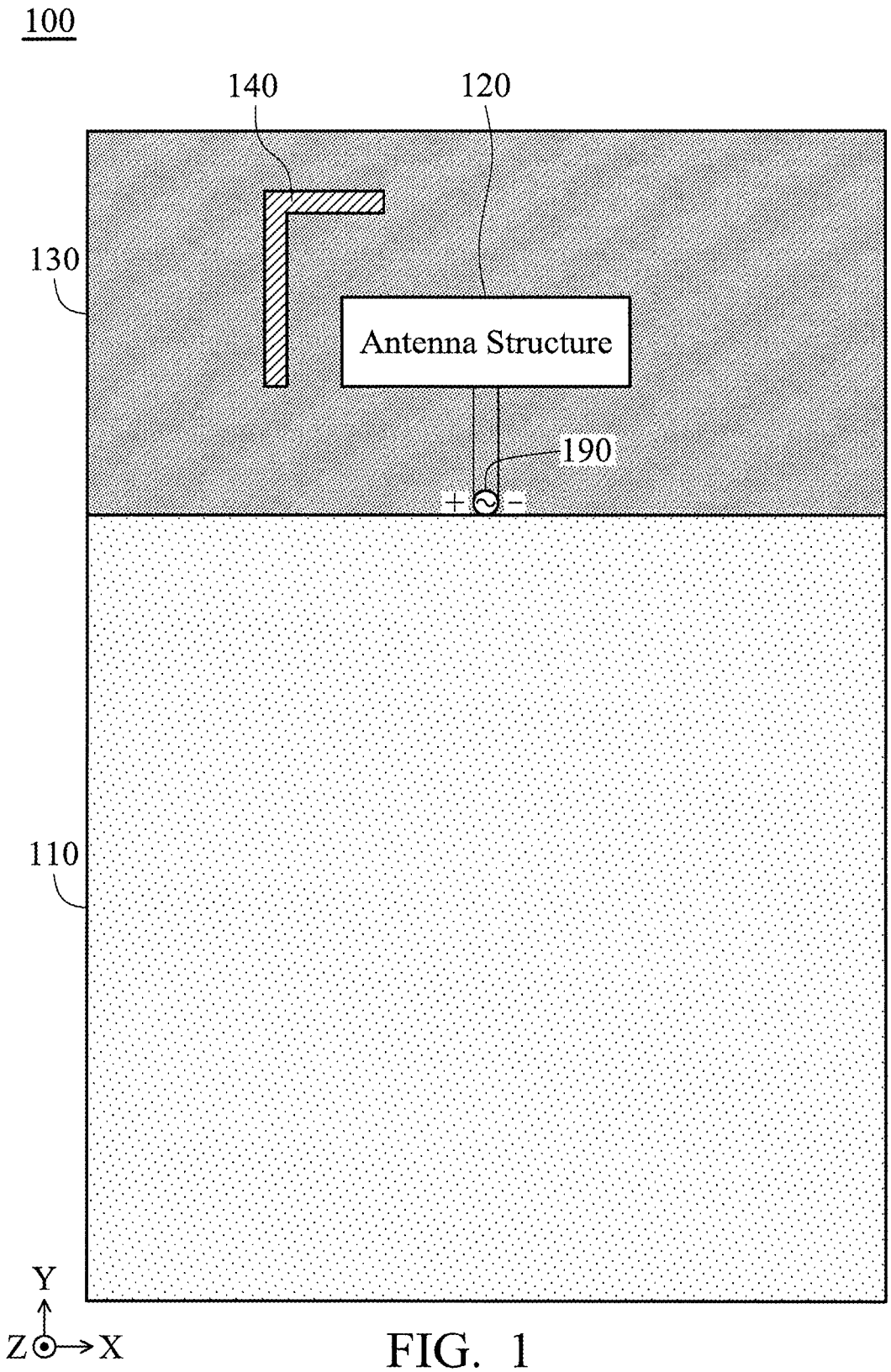
FIG. 1 is a top view of a communication device according to an embodiment of the invention.

FIG. 1 is a top view of a communication device 100 according to an embodiment of the invention. The communication device 100 can be applied in a wireless access point. As shown in FIG. 1, the communication device 100 at least includes a system ground plane 110, an antenna structure 120, a radiation adjustment plane 130, and a first tuning metal element 140. The system ground plane 110 and the radiation adjustment plane 130 may be made of metal materials, such as copper, silver, aluminum, iron, or their alloys. The radiation adjustment plane 130 can be directly or indirectly coupled to the system ground plane 110, and they can also be respectively positioned at two parallel planes. The shape and type of the antenna structure 120 are not limited in the invention. For example, the antenna structure 120 may be a monopole antenna, a dipole antenna, a loop antenna, a patch antenna, a helical antenna, or a chip antenna. The radiation adjustment plane 130 is disposed below the antenna structure 120, and is configured to reflect the radiation of the antenna structure 120, thereby increasing the antenna gain of the antenna structure 120. The first tuning metal element 140 is disposed adjacent to the antenna structure 120, and is configured to modify the radiation pattern of the antenna structure 120. The antenna structure 120 is excited by a signal source 190. The signal source 190 may be from an RF (Radio Frequency) module. It should be understood that the communication device 100 may include other components, such as a dielectric substrate, a display device, a signal processor, a power supply module, and a housing (figure not shown).

The detailed structure and element arrangement of the communication device 100 will be described in the following embodiments and figures. It should be understood that these embodiments and figures are just exemplary, rather than limitations of the scope of the patent application.

Figure 2A:
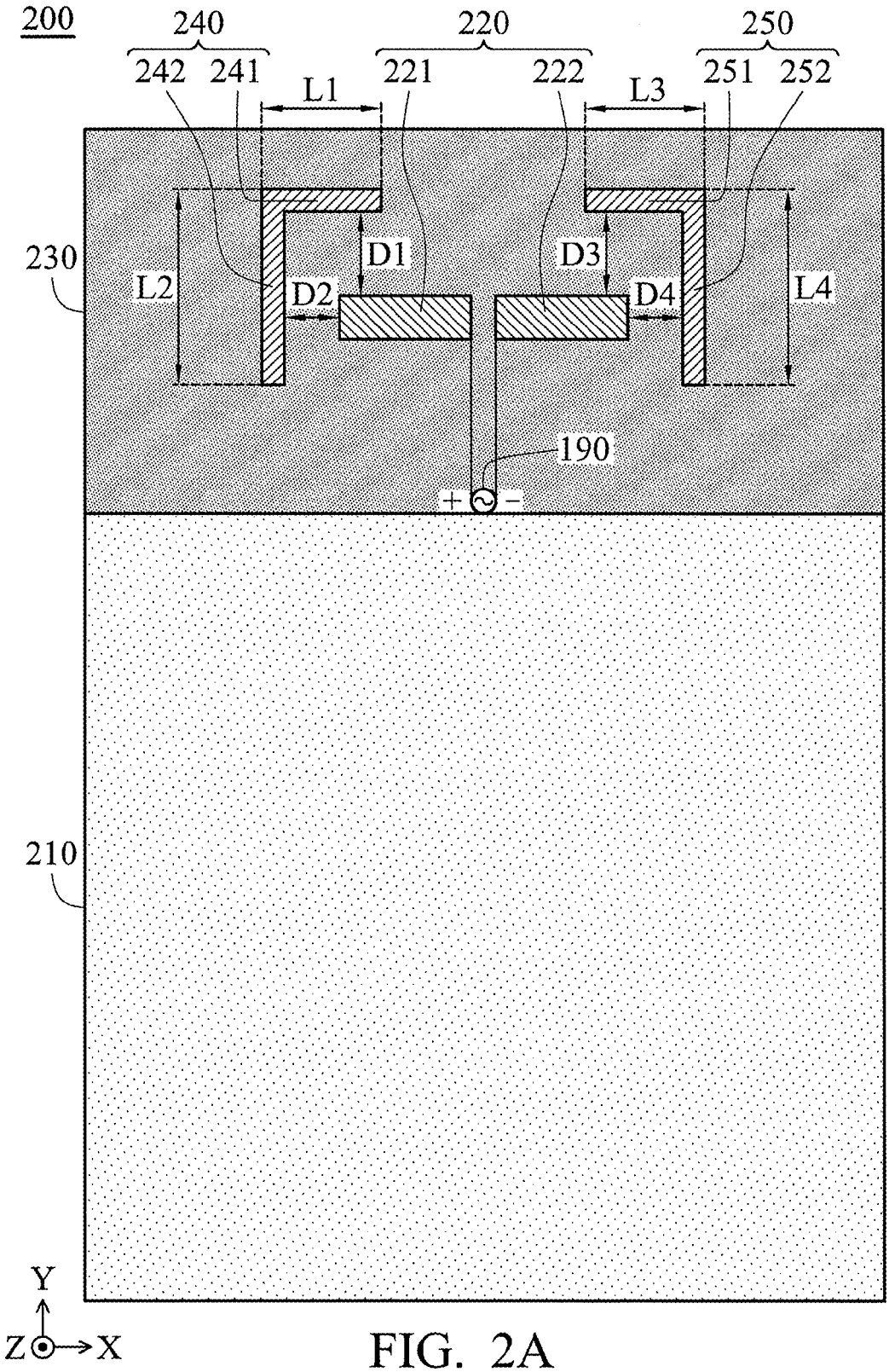
FIG. 2A is a top view of a communication device according to an embodiment of the invention.

FIG. 2A is a top view of a communication device 200 according to an embodiment of the invention. In the embodiment of FIG. 2A, the communication device 200 includes a system ground plane 210, an antenna structure 220, a radiation adjustment plane 230, a first tuning metal element 240, and a second tuning metal element 250. The radiation adjustment plane 230 is coupled to the system ground plane 210. The radiation adjustment plane 230 is disposed below the antenna structure 220, and is configured to reflect the radiation of the antenna structure 220. The second tuning metal element 250 is considered as a mirror image of the first tuning metal element 240. The first tuning metal element 240 and the second tuning metal element 250 are symmetrically disposed at the left side and right side of the antenna structure 220, respectively. The first tuning metal element 240 and the second tuning metal element 250 are both disposed adjacent to the antenna structure 220, and are configured to modify the radiation pattern of the antenna structure 220.

In the embodiment of FIG. 2A, the antenna structure 220 is a dipole antenna. The dipole antenna includes a feeding radiation element 221 and a grounding radiation element 222. The feeding radiation element 221 is coupled to a positive electrode of the signal source 190, and the grounding radiation element 222 is coupled to a negative electrode of the signal source 190. Each of the feeding radiation element 221 and the grounding radiation element 222 has a straight-line shape. Preferably, the feeding radiation element 221, the grounding radiation element 222, the first tuning metal element 240, and the second tuning metal element 250 may be disposed on the same plane. The distance between the aforementioned plane and the radiation adjustment plane 230 is from 0.1 to 0.5 wavelength (0.1λ to 0.5λ) of the operation frequency band of the antenna structure 220. Furthermore, in other embodiments, the vertical projections of the feeding radiation element 221, the grounding radiation element 222, the first tuning metal element 240, and the second tuning metal element 250 can be positioned either inside or outside the radiation adjustment plane 230.

Figure 2B:
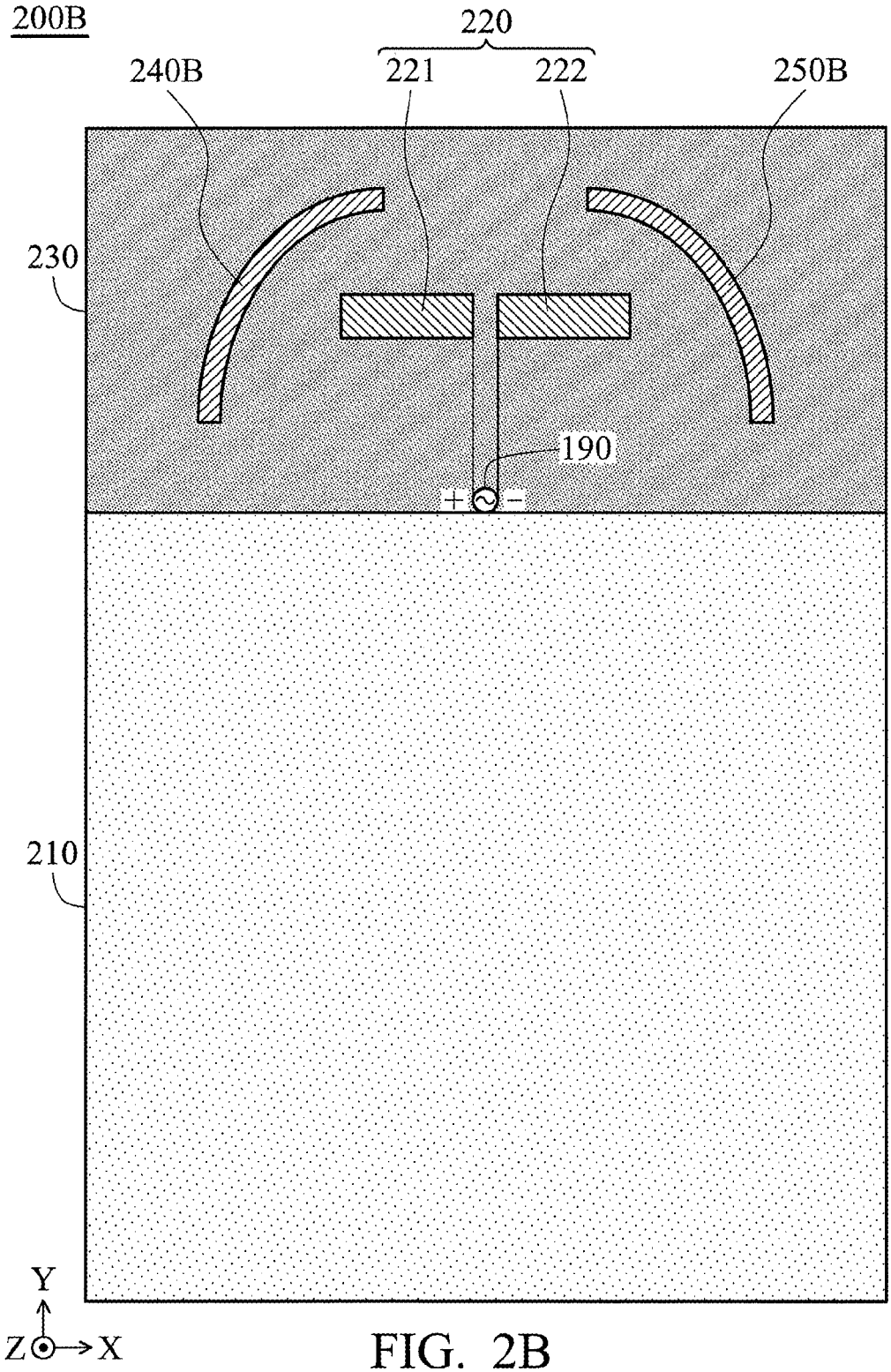
FIG. 2B is a top view of a communication device according to an embodiment of the invention.
Figure 2C:
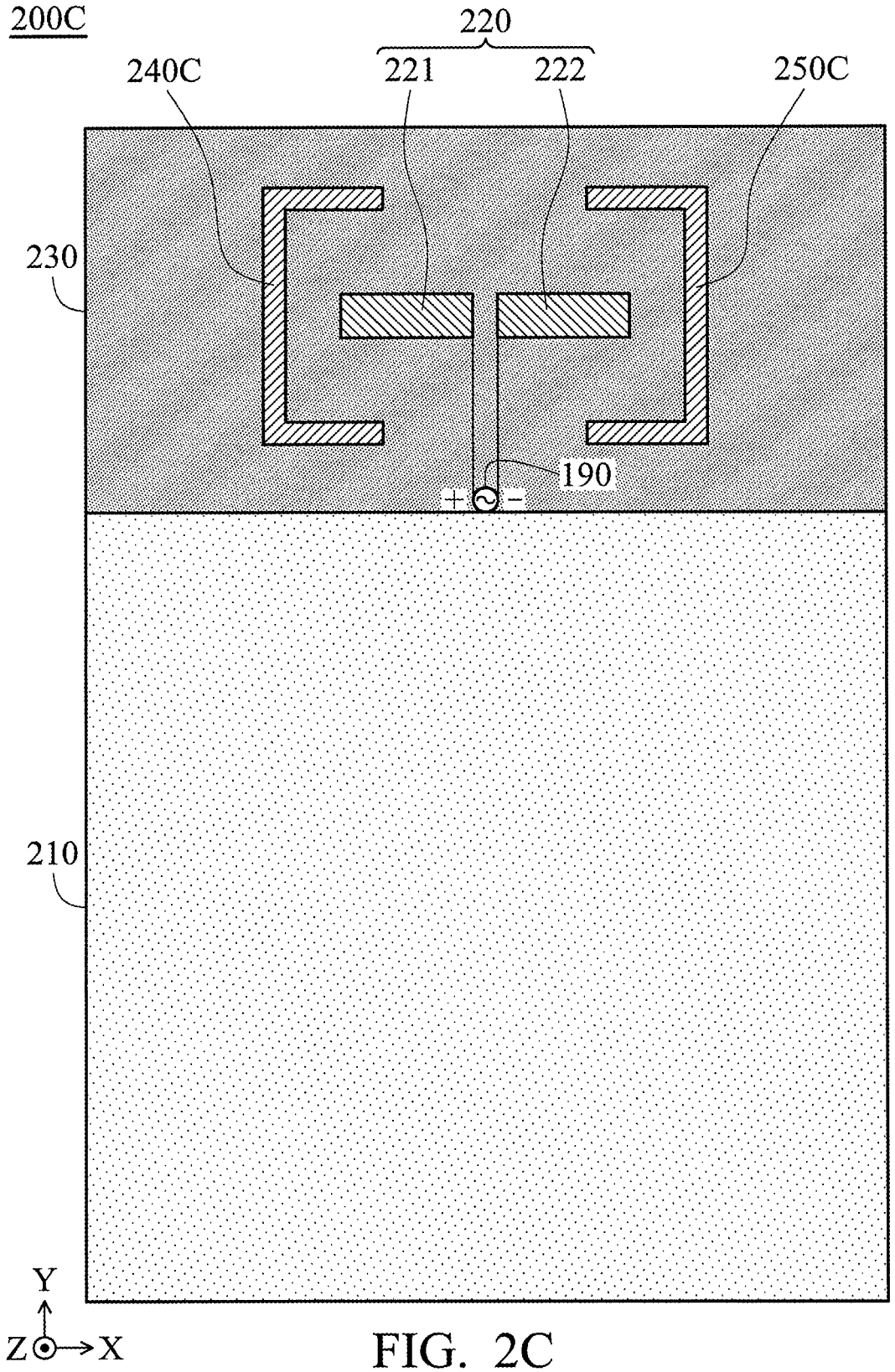
FIG. 2C is a top view of a communication device according to an embodiment of the invention.

The first tuning metal element 240 is float and adjacent to the antenna structure 220. The first tuning metal element 240 and the antenna structure 220 are completely separated from each other. The mutual coupling is induced between the first tuning metal element 240 and the antenna structure 220. The first tuning metal element 240 may substantially have an L-shape, a quarter-arc-shape (as shown in FIG. 2B), or a U-shape (as shown in FIG. 2C). The first tuning metal element 240 has two open ends. Specifically, with respect to the L-shape of the embodiment of FIG. 2A, the first tuning metal element 240 includes a first portion 241 and a second portion 242. The second portion 242 is perpendicular to the first portion 241. The length L1 of the first portion 241 is shorter than the length L2 of the second portion 242. The first portion 241 resonates with the feeding radiation element 221 of the antenna structure 220 and generates a first coupling current. The first coupling current is arranged for compensating for the nulls of the radiation pattern of the antenna structure 220. It should be noted that the structures of the first portion 241 and the second portion 242 of the first tuning metal element 240 are not limited to the configuration set forth above. As a matter of fact, if the first portion 241 and the second portion 242 are continuous and disposed at two sides of the feeding radiation element 221, the first coupling current for compensating for the nulls of the radiation pattern of the antenna structure 220 can be generated. The second tuning metal element 250 is float and adjacent to the antenna structure 220. The second tuning metal element 250 and the antenna structure 220 are completely separated from each other. The mutual coupling is induced between the second tuning metal element 250 and the antenna structure 220. The second tuning metal element 250 may substantially have an L-shape, a quarter-arc-shape (as shown in FIG. 2B), or a U-shape (as shown in FIG. 2C). The second tuning metal element 250 has two open ends. Specifically, with respect to the L-shape of the embodiment of FIG. 2A, the second tuning metal element 250 includes a third portion 251 and a fourth portion 252. The fourth portion 252 is perpendicular to the third portion 251. The length L3 of the third portion 251 is shorter than the length L4 of the fourth portion 252. The third portion 251 resonates with the grounding radiation element 222 of the antenna structure 220 and generates a second coupling current. The second coupling current is arranged for compensating for the nulls of the radiation pattern of the antenna structure 220. It should be noted that the structures of the third portion 251 and the fourth portion 252 of the second turning metal element 250 are not limited to the configuration set forth above embodiment. As a matter of fact, if the third portion 251 and the fourth portion 252 are continuous and disposed at two sides of the grounding radiation element 222, the second coupling current for compensating for the nulls of the radiation pattern of the antenna structure 220 can be generated.

With respect to antenna theory, the feeding radiation element 221 and the grounding radiation element 222 of the antenna structure 220 are both disposed parallel to the X-axis, and their resonant currents are also parallel to the X-axis, such that the radiation pattern of the antenna structure 220 has nulls in the +X-axis direction and the −X-axis direction. In order to arrange the antenna structure 220 toward the desired radiation pattern, the invention adds at least one of the first tuning metal element 240 and the second tuning metal element 250. With such a design, the mutual coupling is induced between the first tuning metal element 240 and the feeding radiation element 221 of the antenna structure 220, and the first coupling current flows through the second portion 242 of the first tuning metal element 240 and is parallel to the Y-axis. Similarly, the mutual coupling is induced between the second tuning metal element 250 and the grounding radiation element 222 of the antenna structure 220, and the second coupling current flows through the fourth portion 252 of the second tuning metal element 250 and is parallel to the Y-axis. Since the first coupling current of the first tuning metal element 240 and the second coupling current of the second tuning metal element 250 are both perpendicular to the direction of the resonant current of the antenna structure 220, these coupling currents can compensate for the pattern nulls of the antenna structure 220 in the +X-axis direction and the −X-axis direction. Accordingly, the communication device 200 has relatively uniform antenna gain in a variety of directions in which energy concentration is required.

In some embodiments, the operation frequency band of the antenna structure 220 is from 57 GHz to 66 GHz, and the related element sizes are as follows. The length L1 of the first portion 241 of the first tuning metal element 240 is from ⅑ to ⅓ wavelength (λ/9 to λ/3) of the operation frequency band, and is preferably ¼ wavelength (λ/4). The length L2 of the second portion 242 of the first tuning metal element 240 is about ½ wavelength (λ/2) of the operation frequency band. The length L3 of the third portion 251 of the second tuning metal element 250 is from ⅑ to ⅓ wavelength (λ/9 to λ/3) of the operation frequency band, and is preferably ¼ wavelength (λ/4). The length L4 of the fourth portion 252 of the second tuning metal element 250 is about ½ wavelength (λ/2) of the operation frequency band. Specifically, the length L1 and the length L3 are used to control the amount of mutual coupling between the antenna structure 220 and the corresponding tuning metal element, and the length L2 and the length L4 are used to control the resonant frequency of the corresponding tuning metal element. The distance D1 between the first portion 241 of the first tuning metal element 240 and the feeding radiation element 221 is from 1/20 to ⅓ wavelength (λ/20 to λ/3) of the operation frequency band, and is preferably ⅕ wavelength (λ/5). The distance D2 between the second portion 242 of the first tuning metal element 240 and the feeding radiation element 221 is from 1/20 to ½ wavelength (λ/20 to λ/2) of the operation frequency band, and is preferably ⅛ wavelength (λ/8). The distance D3 between the third portion 251 of the second tuning metal element 250 and the grounding radiation element 222 is from 1/20 to ⅓ wavelength (λ/20 to λ/3) of the operation frequency band, and is preferably ⅕ wavelength (λ/5). The distance D4 between the fourth portion 252 of the second tuning metal element 250 and the grounding radiation element 222 is from 1/20 to ½ wavelength (λ/20 to λ/2) of the operation frequency band, and is preferably ⅛ wavelength (λ/8). The above element sizes are calculated and obtained according to many simulation results, and they can optimize the antenna gain and radiation pattern of the communication device 200.

Figure 3:
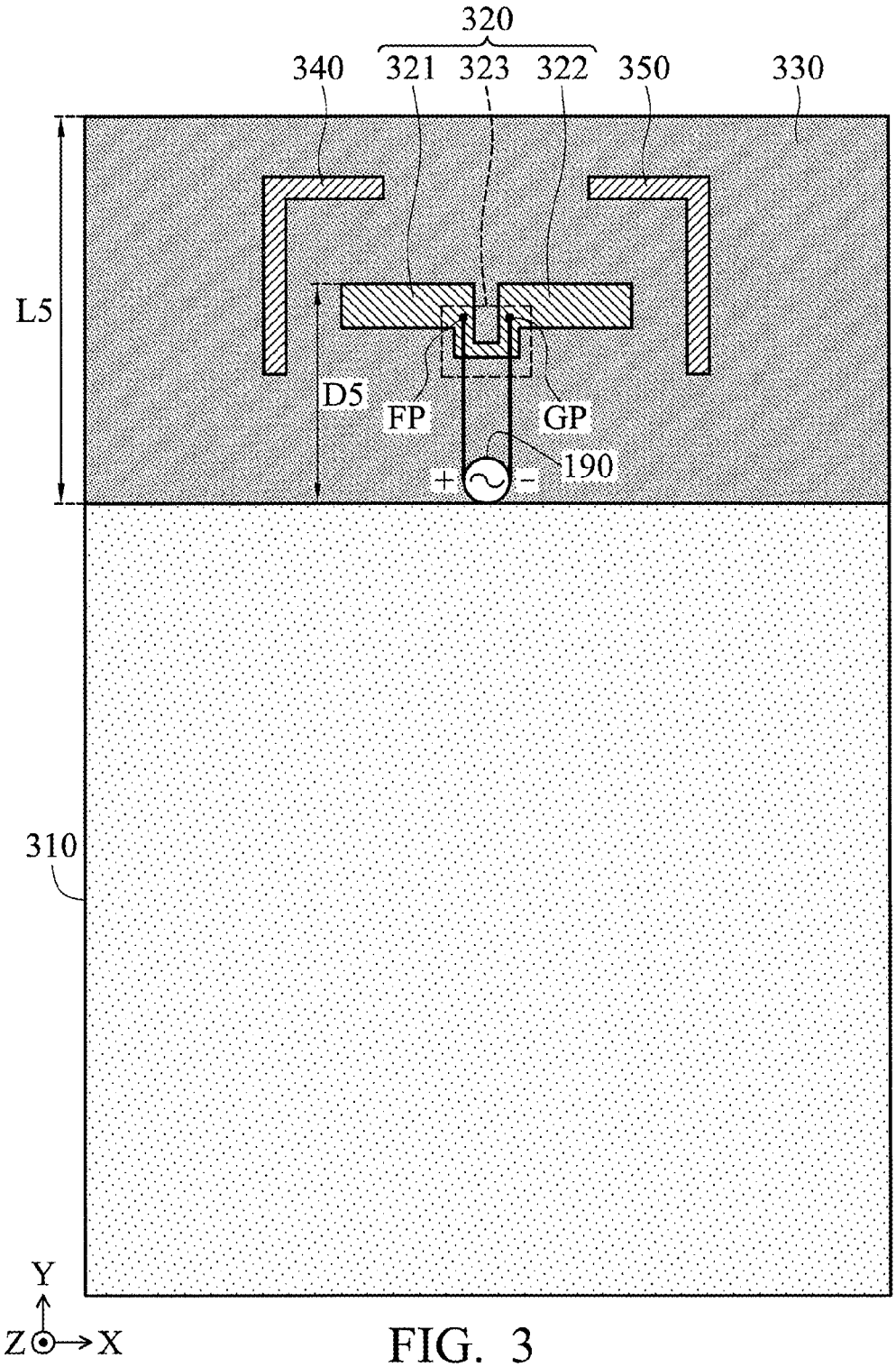
FIG. 3 is a top view of a communication device according to an embodiment of the invention.

FIG. 3 is a top view of a communication device 300 according to an embodiment of the invention. In the embodiment of FIG. 3, the communication device 300 includes a system ground plane 310, an antenna structure 320, a radiation adjustment plane 330, a first tuning metal element 340, and a second tuning metal element 350. The structures and functions of the system ground plane 310, the antenna structure 320, the radiation adjustment plane 330, the first tuning metal element 340, and the second tuning metal element 350 are substantially similar to the embodiments illustrated in FIG. 1 and FIG. 2.

In the embodiment of FIG. 3, the antenna structure 320 includes a feeding radiation element 321, a grounding radiation element 322, and a shorting metal element 323. The shorting metal element 323 is directly coupled between the feeding radiation element 321 and the grounding radiation element 322, so as to adjust impedance matching of the antenna structure 320. The shorting metal element 323 may have a different shape, such as a straight-line shape, or a U-shape shown in this embodiment. The shorting metal element 323 connects a feeding point FP of the feeding radiation element 321 to a grounding point GP of the grounding radiation element 322. According to the practical measurement result, the inductance of the shorting metal element 323 can compensate for the capacitance of the radiation adjustment plane 330, so as to optimize the impedance matching of the antenna structure 320.

As to the element sizes, the length L5 of the radiation adjustment plane 330 is longer than or equal to the distance D5 between the antenna structure 320 and the system ground plane 310. The length L5 of the radiation adjustment plane 330 is arranged for adjusting the radiation pattern of the antenna structure 320. For example, if the length L5 of the radiation adjustment plane 330 approximates the distance D5 between the antenna structure 320 and the system ground plane 310, the radiation pattern of the antenna structure 320 can cover a relatively large spatial angle (e.g., a zenith angle from 0 to 120 degrees); conversely, if the length L5 of the radiation adjustment plane 330 is longer than the distance D5 between the antenna structure 320 and the system ground plane 310, the radiation pattern of the antenna structure 320 can cover a relatively small spatial angle (e.g., a zenith angle from 0 to 90 degrees). The distance between the antenna structure 320 and the radiation adjustment plane 330 is from 0.1 to 0.5 wavelength (0.1λ to 0.5λ) of the operation frequency band of the antenna structure 320, and it helps to generate constructive interferences.

Figure 4:
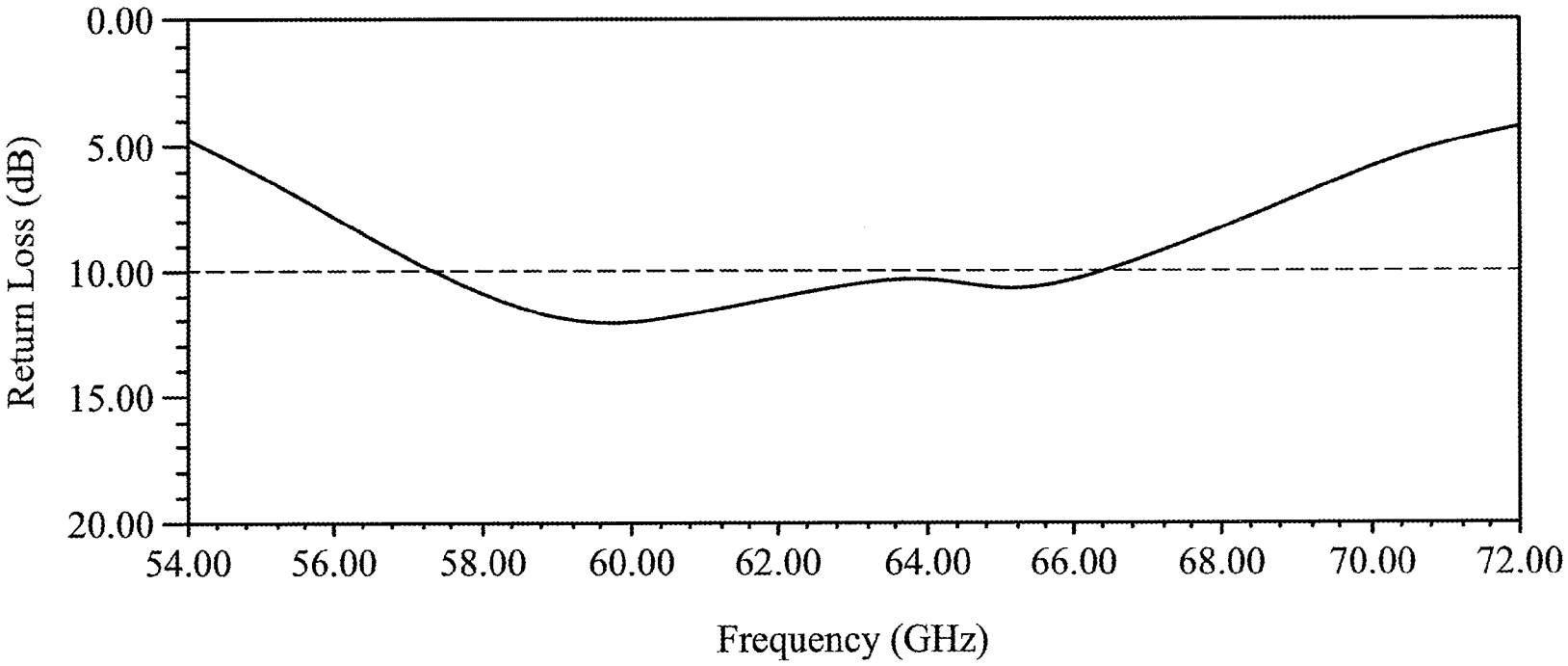
FIG. 4 is a diagram of return loss of an antenna structure of a communication device according to an embodiment of the invention.

FIG. 4 is a diagram of return loss of the antenna structure 320 of the communication device 300 according to an embodiment of the invention. According to the measurement result of FIG. 4, the antenna structure 320 of the communication device 300 covers an operation frequency band from 57 GHz to 66 GHz.

Figure 5A:
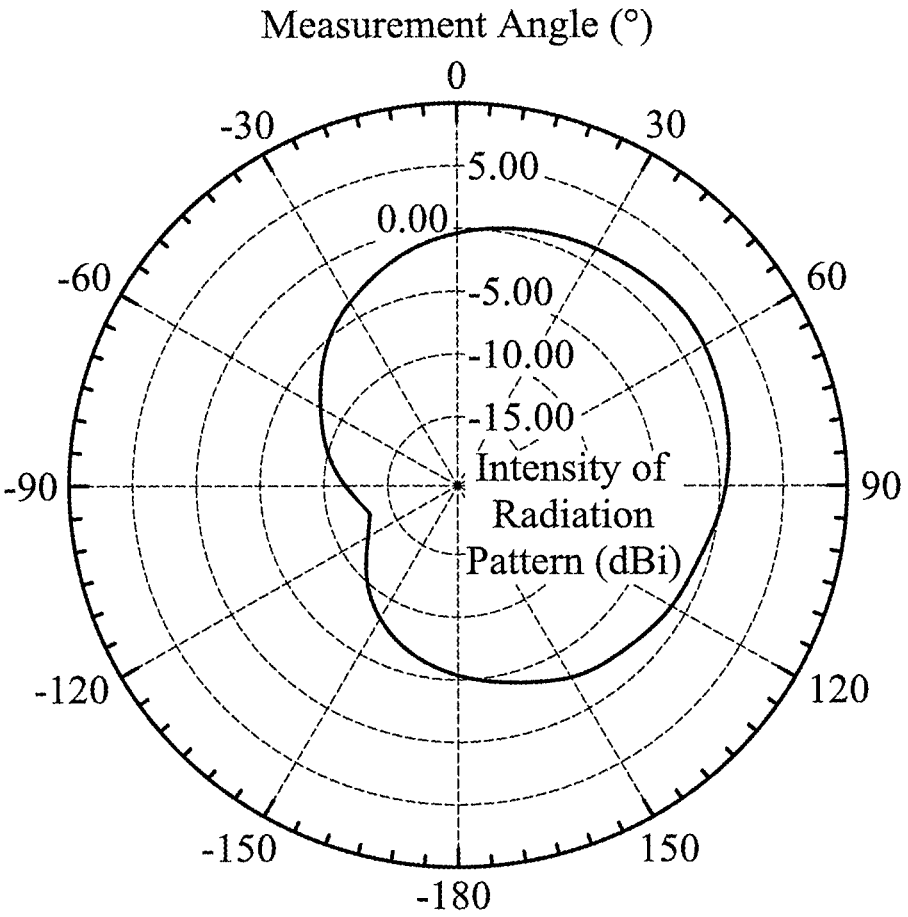
FIG. 5A is a radiation pattern of an antenna structure of a communication device according to an embodiment of the invention.
Figure 5B:
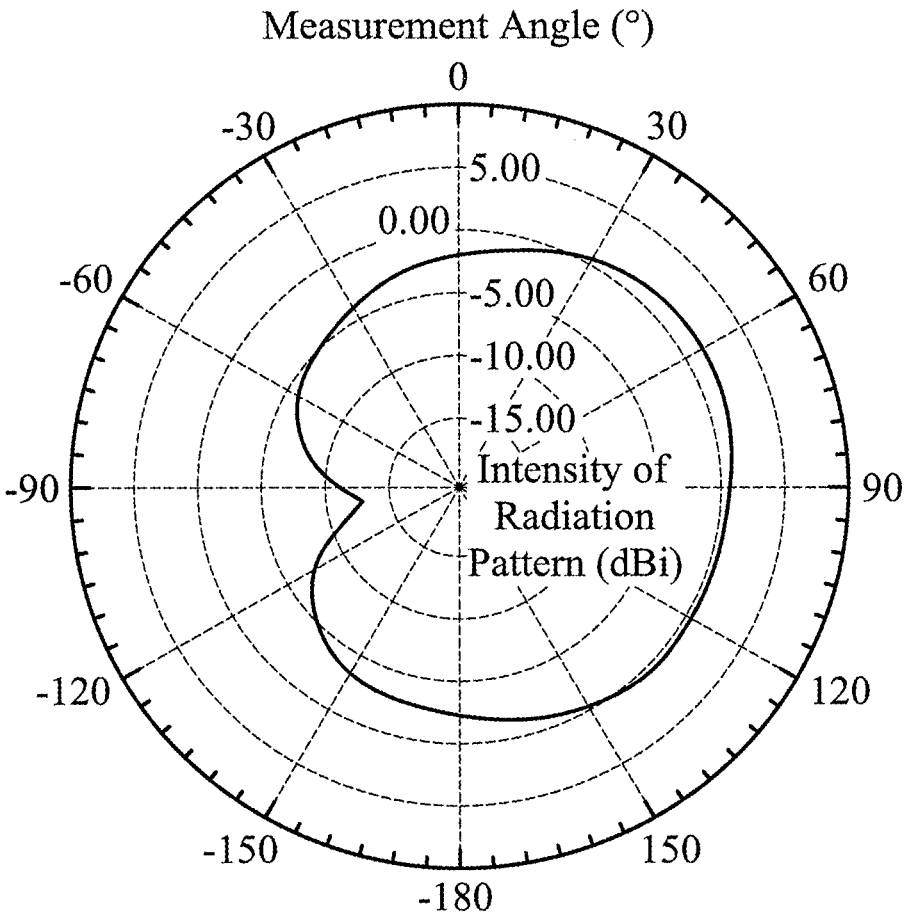
FIG. 5B is a radiation pattern of an antenna structure of a communication device according to an embodiment of the invention.

FIG. 5A is a radiation pattern of the antenna structure 320 of the communication device 300 measured on the YZ-plane according to an embodiment of the invention. FIG. 5B is a radiation pattern of the antenna structure 320 of the communication device 300 measured on the XY-plane according to an embodiment of the invention. According to the measurement result of FIG. 5A and FIG. 5B, the antenna structure 320 of the communication device 300 can generate a radiation pattern which meets the user's requirements and eliminates the pattern nulls in the +X-axis direction and −X-axis direction. Therefore, the communication device 300 is suitable for application in a variety of wireless communication devices, so as to receive and transmit signals in different directions.

Note that the above element sizes, element parameters, element shapes, and frequency ranges are not limitations of the invention. An antenna designer can fine-tune these settings or values according to different requirements. It should be understood that the communication device and antenna structure of the invention are not limited to the configurations of FIGS. 1-5. The invention may merely include any one or more features of any one or more embodiments of FIGS. 1-5. In other words, not all of the features displayed in the figures should be implemented in the communication device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:

a system ground plane;

a signal source, coupled to the system ground plane;

an antenna structure, coupled to the signal source, wherein the antenna structure is a dipole antenna comprising a feeding radiation element and a grounding radiation element;

a radiation adjustment plane, configured to adjust radiation of the antenna structure;

a first tuning metal element, floating and not connected to the system ground plane, wherein the first tuning metal element is disposed adjacent to the feeding radiation element, and configured to modify a radiation pattern of the antenna structure; and a second tuning metal element, floating and not connected to the system ground plane, wherein the second tuning metal element is disposed adjacent to the grounding radiation element, and configured to modify the radiation pattern of the antenna structure;

wherein a first distance between a first portion of the first tuning metal element and a side of the antenna structure is from 1/20 to 1/3 wavelength of an operation frequency band of the antenna structure, and a second distance between a second portion of the first tuning metal element and another side of the antenna structure perpendicular to the side thereof is from 1/20 to 1/2 wavelength of the operation frequency band, and a length of the second portion is 1/2 wavelength of the operation frequency band;

wherein each of the first tuning metal element and the second tuning metal element is entirely disposed above the system ground plane.

2. The communication device as claimed in claim 1, wherein the radiation adjustment plane is coupled to the system ground plane.

3. The communication device as claimed in claim 1, wherein the operation frequency band of the antenna structure is from 57 GHz to 66 GHz.

4. The communication device as claimed in claim 3, wherein a distance between the antenna structure and the radiation adjustment plane is from 0.1 to 0.5 wavelength of the operation frequency band.

5. The communication device as claimed in claim 1, wherein the first tuning metal element is disposed adjacent to the antenna structure such that mutual coupling is induced between the first tuning metal element and the antenna structure, and the first tuning metal element and the antenna structure are completely separate from each other.

6. The communication device as claimed in claim 1, wherein the first tuning metal element substantially has an L-shape, a quarter-arc-shape, or a U-shape.

7. The communication device as claimed in claim 1, wherein the second portion is perpendicular to the first portion, the first portion resonates with the antenna structure and generates a first coupling current, and the first coupling current is arranged for compensating for nulls of the radiation pattern of the antenna structure.

8. The communication device as claimed in claim 7, wherein a length of the first portion is shorter than the length of the second portion.

9. The communication device as claimed in claim 1, wherein the second tuning metal element is disposed adjacent to the antenna structure such that mutual coupling is induced between the second tuning metal element and the antenna structure, and the second tuning metal element and the antenna structure are completely separate from each other.

10. The communication device as claimed in claim 1, wherein the second tuning metal element substantially has an L-shape, a quarter-arc-shape, or a U-shape.

11. The communication device as claimed in claim 1, wherein the second tuning metal element comprises a third portion and a fourth portion, the fourth portion is perpendicular to the third portion, the third portion resonates with the antenna structure and generates a second coupling current, and the second coupling current is arranged for compensating for nulls of the radiation pattern of the antenna structure.

12. The communication device as claimed in claim 11, wherein a length of the third portion is shorter than a length of the fourth portion.

13. The communication device as claimed in claim 1, wherein the second tuning metal element is like a mirror image of the first tuning metal element.

14. The communication device as claimed in claim 1, wherein the first tuning metal element and the second tuning metal element are symmetrically disposed at a left side and a right side of the antenna structure, respectively.

15. The communication device as claimed in claim 1, wherein the feeding radiation element, the grounding radiation element, the first tuning metal element, and the second tuning metal element lie on a same plane.

16. The communication device as claimed in claim 1, wherein the antenna structure further comprises a shorting metal element, and the shorting metal element is directly coupled between the feeding radiation element and the grounding radiation element, so as to adjust impedance matching of the antenna structure.

17. The communication device as claimed in claim 1, wherein:

the feeding radiation element has a first side and a second side, with the first side being adjacent and perpendicular to the second side;

the first tuning metal element has a third side and a fourth side, with the third side being adjacent and perpendicular to the fourth side; and the first side of the feeding radiation element and the third side of the first tuning metal element are parallel to each other, and the second side of the feeding radiation element and the fourth side of the first tuning metal element are parallel to each other.

* * * * *